US008229129B2

(12) United States Patent
Jeong et al.

(10) Patent No.: US 8,229,129 B2
(45) Date of Patent: Jul. 24, 2012

(54) METHOD, MEDIUM, AND APPARATUS FOR EXTRACTING TARGET SOUND FROM MIXED SOUND

(75) Inventors: So-young Jeong, Seoul (KR); Kwang-cheol Oh, Yongin-si (KR); Jae-hoon Jeong, Yongin-si (KR); Kyu-hong Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 947 days.

(21) Appl. No.: 12/078,942

(22) Filed: Apr. 8, 2008

(65) Prior Publication Data

US 2009/0097670 A1 Apr. 16, 2009

(30) Foreign Application Priority Data

Oct. 12, 2007 (KR) ..... 10-2007-0103166

(51) Int. Cl.
*H04R 3/02* (2006.01)

(52) U.S. Cl. ..... 381/73.1; 381/94.7; 381/94.1; 381/92; 381/93

(58) Field of Classification Search ..... 381/94.7, 381/94.1, 92, 93, 95, 96, 66, 83
See application file for complete search history.

(56) References Cited

U.S. PATENT DOCUMENTS 7,613,310 B2 * 11/2009 Mao ..... 381/94.7

OTHER PUBLICATIONS

Juyang Weng et al., "Three-dimensional sound localization from a compact non-coplanar array of microphones using tree-based learning", 2001 Acoustical Society of America, pp. 310-322.
Steven L. Gay et al., "Acoustic Signal Processing for Telecommunication", Leading the Next, 2 pages.
Gary W. Elko, "Superdirectional Microphone Arrays," in "Acoustic Signal Processing For Telecommunication," Chapter 10, (Steven L. Gay & Jacob Benesty eds., Kluwer Academic Publishers 2000) pp. 181-237.
U.S. Office Action mailed Sep. 13, 2011 for co-pending U.S. Appl. No. 12/458,968, filed Jul. 21, 2009.
U.S. Notice of Allowance mailed Apr. 6, 2012 issued in related U.S. Appl. No. 12/458,698.

* cited by examiner

*Primary Examiner* — Zandra Smith
*Assistant Examiner* — Paul Patton
(74) *Attorney, Agent, or Firm* — Staas & Halsey LLP

(57) ABSTRACT

A method, medium, and apparatus for extracting a target sound from mixed sound. The method includes receiving a mixed signal through a microphone array, generating a first signal whose directivity is emphasized toward a target sound source and a second signal whose directivity toward the target sound source is suppressed based on the mixed signal, and extracting a target sound signal from the first signal by masking an interference sound signal, which is contained in the first signal, based on a ratio of the first signal to the second signal. Therefore, a target sound signal can be clearly separated from a mixed sound signal which contains a plurality of sound signals and is input to a microphone array.

15 Claims, 8 Drawing Sheets

METHOD, MEDIUM, AND APPARATUS FOR EXTRACTING TARGET SOUND FROM MIXED SOUND

CROSS-REFERENCE TO RELATED APPLICATIONS

This application claims the priority of Korean Patent Application No. 10-2007-0103166, filed on Oct. 12, 2007, in the Korean Intellectual Property Office, the disclosure of which is incorporated herein in its entirety by reference.

BACKGROUND

1. Field

One or more embodiments of the present invention relate to a method, medium, and apparatus extracting a target sound from mixed sound, and more particularly, to a method, medium, and apparatus processing mixed sound, which contains various sounds generated by a plurality of sound sources and is input to a portable digital device that can process or capture sounds, such as a cellular phone, a camcorder or a digital recorder, to extract a target sound desired by a user out of the mixed sound.

2. Description of the Related Art

Part of everyday life involves making or receiving phone calls, recording external sounds, and capturing moving images by using portable digital devices. Various digital devices, such as consumer electronics (CE) devices and cellular phones, use a microphone to capture sound. Generally, a microphone array including a plurality of microphones is utilized to implement stereophonic sound which uses two or more channels as contrasted with monophonic sound which uses only a single channel.

The microphone array including microphones can acquire not only sound itself but also additional information regarding directivity of the sound, such as the direction or position of the sound. Directivity is a feature that increases or decreases the sensitivity to a sound signal transmitted from a sound source, which is located in a particular direction, by using the difference in the arrival times of the sound signal at each microphone of the microphone array. When sound signals are obtained using the microphone array, a sound signal coming from a particular direction can be emphasized or suppressed.

As used herein, the term "sound source" denotes a source which radiates sounds, that is, an individual speaker included in a speaker array. In addition, the term "sound field" denotes a virtual region formed by a sound which is radiated from a sound source, that is, a region which sound energy reaches. The term "sound pressure" denotes the power of sound energy which is represented using the physical quantity of pressure.

SUMMARY

One or more embodiments of the present invention provides a method, medium, and apparatus extracting a target sound, in which a target sound can be clearly separated from mixed sound containing a plurality of sound signals and inputted to a microphone array.

Additional aspects and/or advantages will be set forth in part in the description which follows and, in part, will be apparent from the description, or may be learned by practice of the invention.

According to an aspect of the present invention, there is provided a method of extracting a target sound. The method includes receiving a mixed signal through a microphone array, generating a first signal whose directivity is emphasized toward a target sound source and a second signal whose directivity toward the target sound source is suppressed based on the mixed signal, and extracting a target sound signal from the first signal by masking an interference sound signal, which is contained in the first signal, based on a ratio of the first signal to the second signal.

According to another aspect of the present invention, there is provided a computer-readable recording medium on which a program for executing the method of extracting a target sound source is recorded.

According to another aspect of the present invention, there is provided an apparatus for extracting a target sound. The apparatus includes a microphone array receiving a mixed signal, a beam former generating a first signal whose directivity is emphasized toward a target sound source and a second signal whose directivity toward the target sound source is suppressed based on the mixed signal, and a signal extractor extracting a target sound signal from the first signal by masking an interference sound signal, which is contained in the first signal, based on a ratio of the first signal to the second signal.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
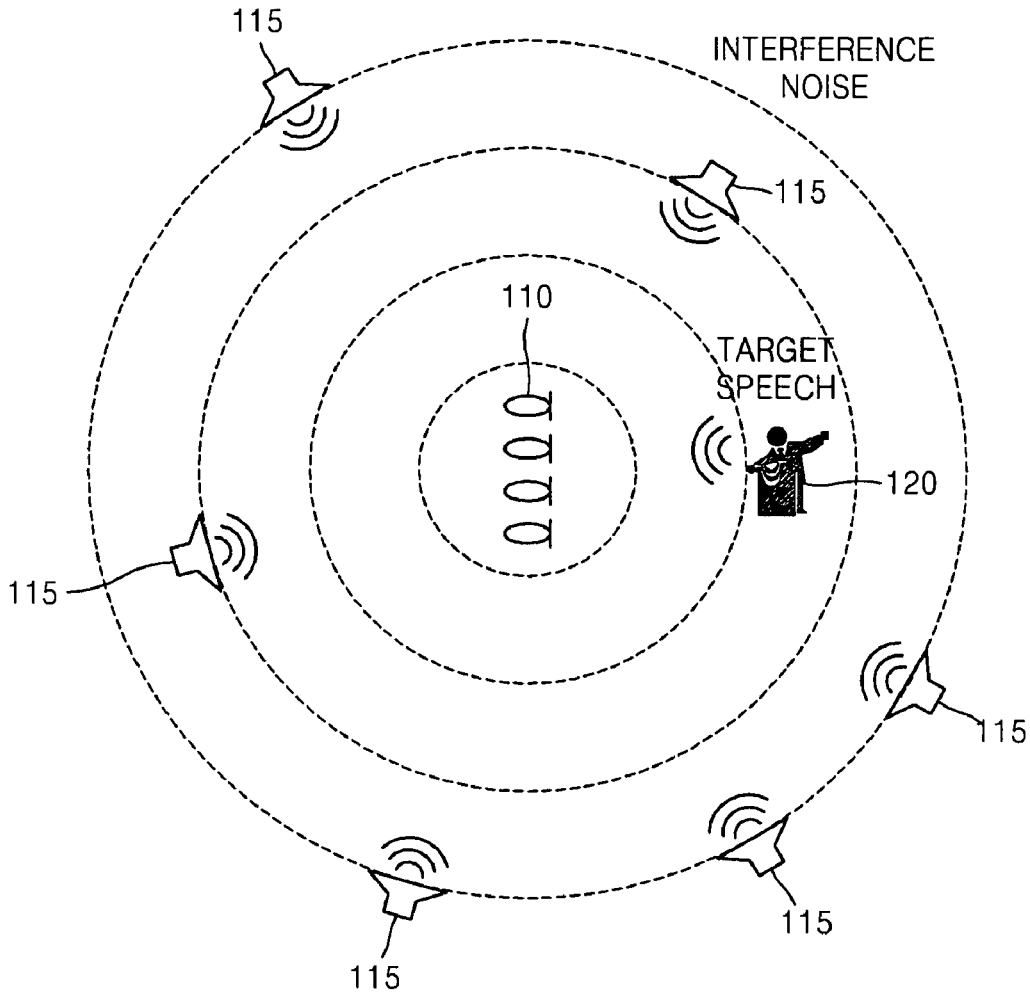
FIG. 1 illustrates a problematic situation that embodiments of the present invention address.

Reference will now be made in detail to the embodiments, examples of which are illustrated in the accompanying drawings, wherein like reference numerals refer to the like elements throughout. In this regard, embodiments of the present invention may be embodied in many different forms and should not be construed as being limited to embodiments set forth herein. Accordingly, embodiments are merely described below, by referring to the figures, to explain aspects of the present invention.

Recording or receiving sounds by using portable digital devices may be performed more often in noisy places with various noises and ambient interference noises than in quiet places without ambient interference noises. When only voice communication was possible using a cellular phone, interference noises input to a microphone included in the cellular phone was not a big problem since the distance between a user and the cellular phone is very close. However, since video and speaker-phone communication is now possible using communication devices, the effect of interference noises on sound signals generated by a user of the communication device has relatively increased, thereby hindering clear communication. In this regard, a method of extracting a target sound from mixed sound is increasingly required by various sound acquiring devices such as consumer electronics (CE) devices and cellular phones with built-in microphones.

FIG. 1 illustrates a problematic situation that embodiments of the present invention address. In FIG. 1, the distance between a microphone array 110 and each adjacent sound source is represented in a concentric circle. Referring to FIG. 1, a plurality of sound sources 115, 120, are located around the microphone array 110, and each sound source is located in a different direction and at a different distance from the microphone array 110. Various sounds generated by the sound sources 115, 120, are mixed into a single sound (hereinafter, referred to as a mixed sound), and the mixed sound is input to the microphone array 110. In this situation, a clear sound generated by a target sound source must be obtained from the mixed sound.

The target sound source may be determined according to an environment in which various embodiments of the present invention are implemented. Generally, a dominant signal from among a plurality of sound signals contained in a mixed sound signal may be determined to be a target sound source. That is, a sound signal having the highest gain or sound pressure may be determined as a target sound source. Alternatively, the directions or distances of the sound sources 115, 120, from the microphone array 110 may be taken into consideration to determine a target sound source. That is, a sound source which is located in front of the microphone array 110 or located closer to the microphone array 110, is more likely to be a target sound source. In FIG. 1, a sound source 120 located close to a front side of the microphone array 110 is determined as a target sound source. Thus, in the situation illustrated in FIG. 1, a sound generated by the sound source 120 is to be extracted from the mixed sound which is input to the microphone array 110.

As described above, since a target sound source is determined according to the environment in which various embodiments of the present invention are implemented, it will be understood by those of ordinary skill in the art that various methods other than the above two methods can be used to determine the target sound source.

Figure 2A:
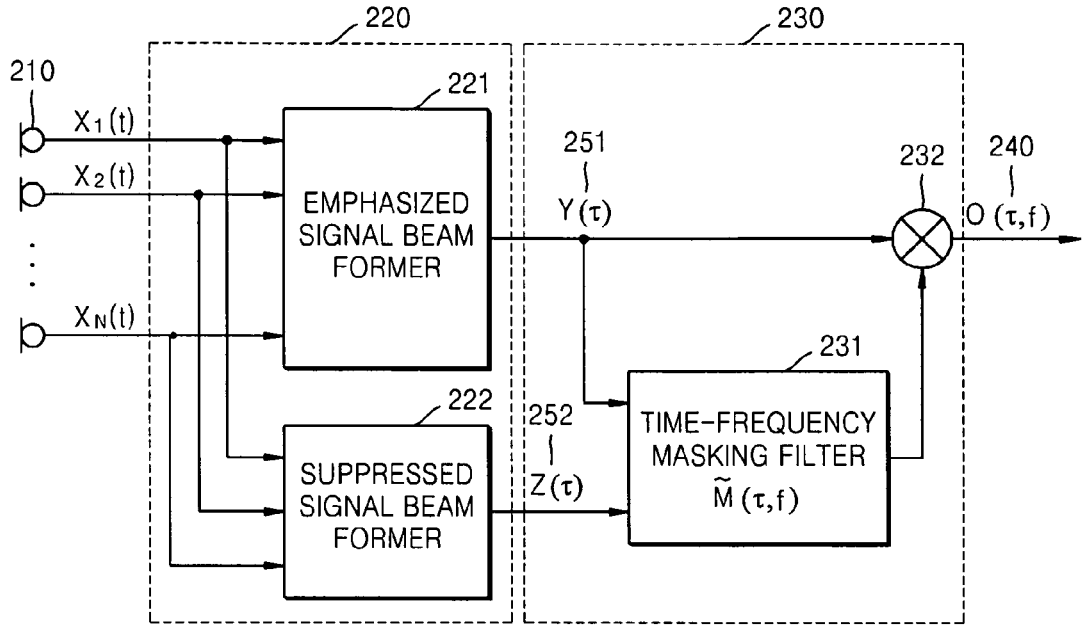
FIGS. 2A and 2B are block diagrams of apparatuses for extracting a target sound signal according to embodiments of the present invention.
Figure 2B:
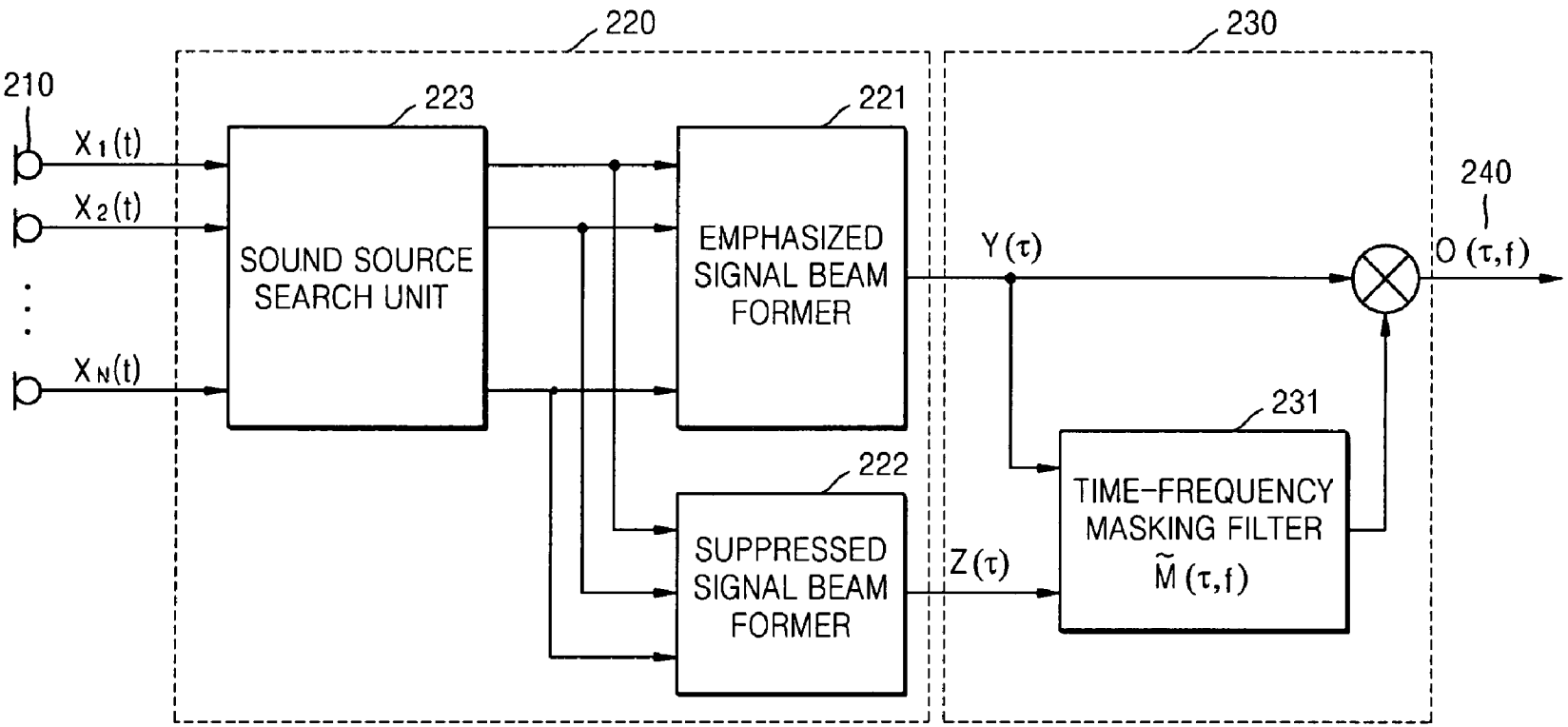

FIGS. 2A and 2B are block diagrams of apparatuses for extracting a target sound signal according to embodiments of the present invention. The apparatus of FIG. 2A can be used when information regarding the direction in which a target sound source is located is given, and the apparatus of FIG. 2B can be used when the information is not given.

The configuration of the apparatus of FIG. 2A is based on an assumption that the direction in which a target sound source is located has been determined using various methods described above with reference to FIG. 1. Referring to FIG. 2A, the apparatus includes a microphone array 210, a beamformer 220, and a signal extractor 230.

The microphone array 210 obtains sound signals generated by a plurality of adjacent sound sources in the form of a mixed sound signal. Since the microphone array 210 includes a plurality of microphones, a sound signal generated by each sound source may arrive at each microphone at a different time, depending on the position of the corresponding sound source and the distance between the corresponding sound source and each microphone. It will be assumed that N sound signals $X_1(t)$ through $X_N(t)$ are received through N microphones of the microphone array 210, respectively.

Based on the sound signals $X_1(t)$ through $X_N(t)$ received through the microphone array 210, the beam former 220 generates signals whose directivity toward the target sound source is emphasized and signals whose directivity toward the target sound source is suppressed. The generation of these signals is respectively performed using an emphasized signal beam former 221 and a suppressed signal beam former 222.

In order to receive a clear target sound signal which is mixed with background noise, a microphone array having two or more microphones generally functions as a spatial filter which increases the amplitude of each sound signal, which is received through the microphone array, by assigning an appropriate weight to each sound signal and spatially reduces noise when the direction of the target sound signal is different from that of an interference noise signal. In this case, the spatial filter is referred to as a beam former. In order to amplify or extract a target sound signal from noise which is coming from a different direction from that of the target sound signal, a microphone array pattern and phase differences between signals which are input to a plurality of microphones, respectively, must be obtained. This signal information can be obtained using a plurality of conventional beamforming algorithms.

Major examples of beam-forming algorithms which can be used to amplify or extract a target sound signal include a delay-and-sum algorithm and a filter-and-sum algorithm. In the delay-and-sum algorithm, the position of a sound source is identified based on a relative period of time by which a sound signal generated by the sound source has been delayed before arriving at a microphone. In the filter-and-sum algorithm, output signals are filtered using a spatially linear filter in order to reduce the effects of two or more signals and noise in a sound field formed by sound sources. These beam-forming algorithms are well known to those of ordinary skill in the art to which the embodiment pertains.

The emphasized signal beam former 221 illustrated in FIG. 2A emphasizes directional sensitivity toward the target sound source, thereby increasing sound pressure of the target sound source signal. A method of adjusting directional sensitivity will now be described with reference to FIGS. 3A and 3B.

Figure 3A:
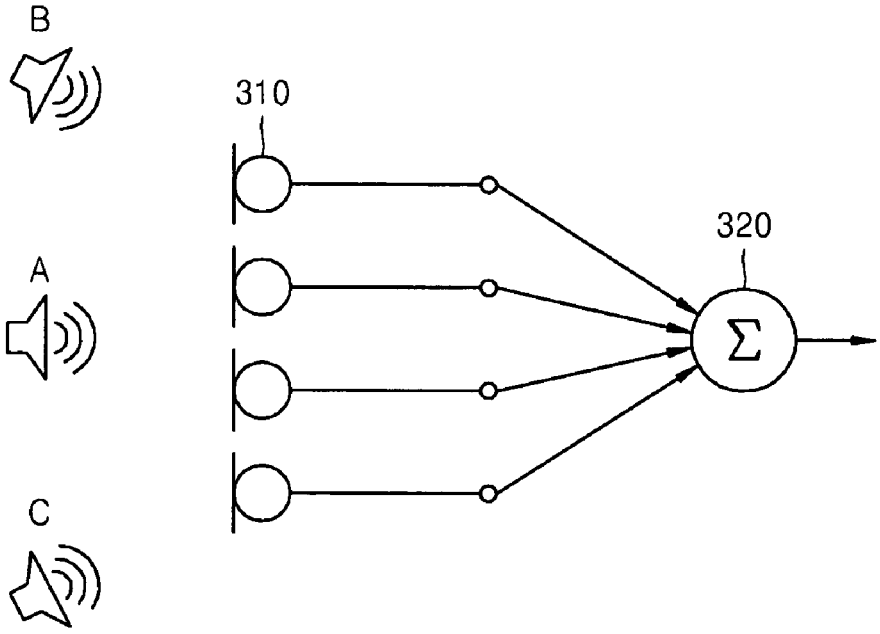
FIGS. 3A and 3B are block diagrams of target sound-emphasizing beam formers according to embodiments of the present invention.
Figure 3B:
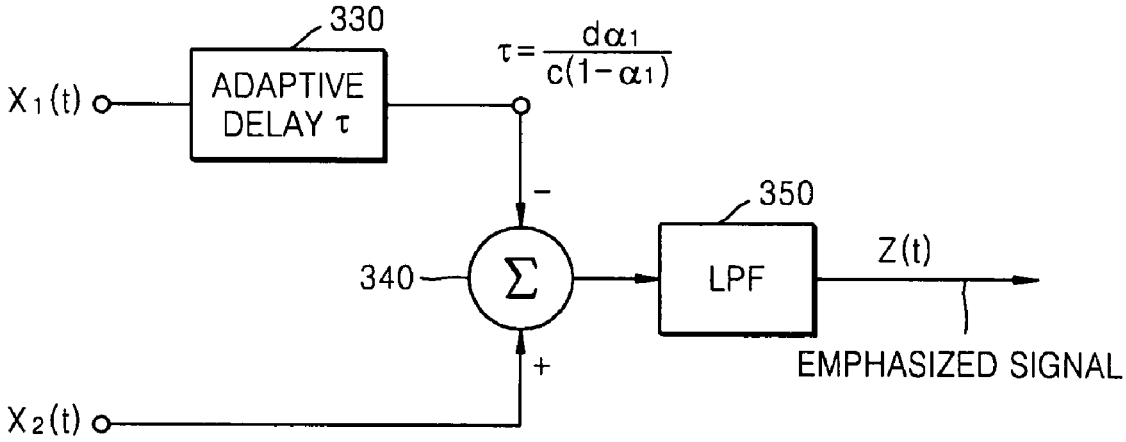

FIGS. 3A and 3B are block diagrams of target sound-emphasizing beam formers according to embodiments of the present invention. A method using a fixed filter and an alternative method using an adaptive delay is illustrated in FIGS. 3A and 3B respectively.

In FIG. 3A, it is assumed that a target sound source is placed in front of a microphone array 310. Based on this assumption, sound signals received through the microphone array 310 are added by an adder 320 to increase sound pressure of the target sound source, which, in turn, emphasizes directivity toward the target sound source. Referring to FIG. 3A, a plurality of sound sources are located at positions including positions A, B and C, respectively. Since it is assumed that the target sound source is located in front of the microphone array 310, that is, at the position A, in the present embodiment, sounds generated by the sound sources located at the positions B and C are interference noises.

When a mixed sound signal is input to the microphone array 310, a sound signal, which is included in the mixed sound signal and transmitted from the position A in front of the microphone array 310 may also be input to the microphone array 310. In this case, the phase and size of the sound signal received by each microphone of the microphone array 310 may be almost identical. The adder 320 adds the sound signals, which are received by the microphones of the microphone array 310, respectively, and outputs a sound signal having increased gain and unchanged phase.

On the other hand, when a sound signal transmitted from the position B or C is input to the microphone array 310, it may arrive at each microphone of the microphone array 310 at a different time since each microphone is at a different distance and angle from the sound source located at the position B or C. That is, the sound signal generated by the sound source at the position B or C may arrive at a microphone, which is located closer to the sound source, earlier and may arrive at a microphone, which is located further from the sound source, relatively later.

When the adder 320 adds the sound signals respectively received by the microphones at different times, the sound signals may partially offset each other due to the difference in their arrival times. Otherwise, the gains of the sound signals may be reduced due to the differences between the phases thereof. Although the phases of the sound signals do not differ from one another by the same amounts, the gain of the sound signal transmitted from the position B or C is reduced relatively more than that of the sound signal transmitted from the position A. Therefore, as in the present embodiment, the directional sensitivity toward the target sound source in front of the microphone array 310 can be enhanced using the microphone array 310, which includes the microphones spaced at regular intervals, and the adder 320.

FIG. 3B is a block diagram of a target sound-emphasizing beam former for increasing directivity toward a target sound source. For the simplicity of description, a first-order differential microphone structure composed of two microphones is used. When sound signals $X_1(t)$ and $X_2(t)$ are received through a microphone array, a delay unit, for example, an adaptive delay unit as shown 330, delays the sound signal $X_1(t)$ by a predetermined period of time by performing adaptive delay control. Then, a subtractor 340 subtracts the delayed sound signal $X_1(t)$ from the sound signal $X_2(t)$. Consequently, a sound signal having directivity toward a certain target sound source is generated. Finally, a low-pass filter (LPF) 350 filters the generated sound signal and outputs an emphasized signal which is independent of frequency changes of the sound signal ("Acoustical Signal Processing for Telecommunication," Steven L. Gay and Jacob Benesty, Kluwer Academic Publishers, 2000). The above beam former is referred to as a delay-and-subtract beam former and will be only briefly described in relation to embodiments of the present invention since it can be easily understood by those of ordinary skill in the art to which the embodiments pertain.

Generally, directional control factors, such as the gap between microphones of a microphone array and delay times of sound signals transmitted to the microphones, are widely used to determine the directional response of the microphone array. The relationship between the directional control factors is defined by Equation 1, for example.

$$\tau = \frac{d\alpha_1}{c(1-\alpha_1)} \qquad \text{Equation 1}$$

Here, $\tau$ is an adaptive delay which determines the directional response of the microphone array, d is the gap between the microphones, $\alpha_1$ is a control factor introduced to define the relationship between the directional control factors, and c is the velocity of sound wave in air, that is, 340 m/sec.

In FIG. 3B, the delay unit 330 determines an adaptive delay using Equation 1 and based on a direction of a target sound source, of which the signals featuring such directivity are to be emphasized, and delays the sound signal $X_1(t)$ by a value of the determined delay. Then, the subtractor 340 subtracts the delayed sound signal $X_1(t)$ from the sound signal $X_2(t)$. Due to this delay, each sound signal arrives at each microphone of the microphone array at a different time. Consequently, a signal to be emphasized, featuring directivity toward a particular target sound source, can be obtained from the sound signals $X_1(t)$ and $X_2(t)$ received through the microphone array.

A sound pressure field of the sound signal $X_1(t)$ delayed by the delay unit 330 is defined as a function of each angular frequency of the sound signal $X_1(t)$ and an angle at which the sound signal $X_1(t)$ from a sound source is incident to the microphone array. The sound pressure field is changed by various factors such as the gap between the microphones or an incident angle of the sound signal $X_1(t)$. Of these factors, the frequency or amplitude of the sound signal $X_1(t)$ varies according to properties thereof. Therefore, it is difficult to control the sound pressure field of the sound signal $X_1(t)$. For this reason, it is desirable for the sound pressure field of the sound signal $X_1(t)$ to be controlled using the adaptive delay of Equation 1, in that Equation 1 is irrespective of changes in the frequency or amplitude of the sound signal $X_1(t)$.

The LPF 350 ensures that frequency components, which are contained in the sound pressure field of the sound signal $X_1(t)$, remain unchanged in order to restrain the sound pressure field from being changed by changes in the frequency of the sound signal $X_1(t)$. Thus, after the LPF 350 filters a sound signal output from the subtractor 340, the directivity toward the target sound source can be controlled using the adaptive delay of Equation 1, irrespective of the frequency or amplitude of the sound signal. That is, an emphasized sound signal Z(t) featuring directivity toward the target source and thus is emphasized, may be generated by the target sound-emphasizing beam former of FIG. 3B.

The target sound-emphasizing beam formers according to two exemplary embodiments of the present invention have been described above with reference to FIGS. 3A and 3B. Contrary to a target sound-emphasizing beam former, a target sound-suppressing beam former suppresses directivity toward a target sound source and thus attenuates a sound signal which is transmitted from the direction in which the target sound source is located.

Figure 4A:
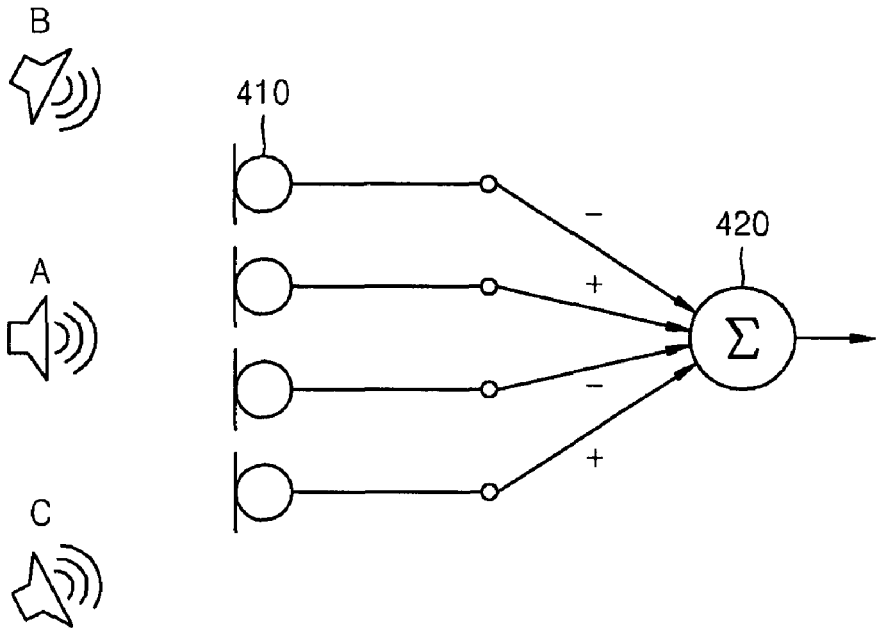
FIGS. 4A and 4B are block diagrams of target sound-suppressing beam formers according to embodiments of the present invention.
Figure 4B:
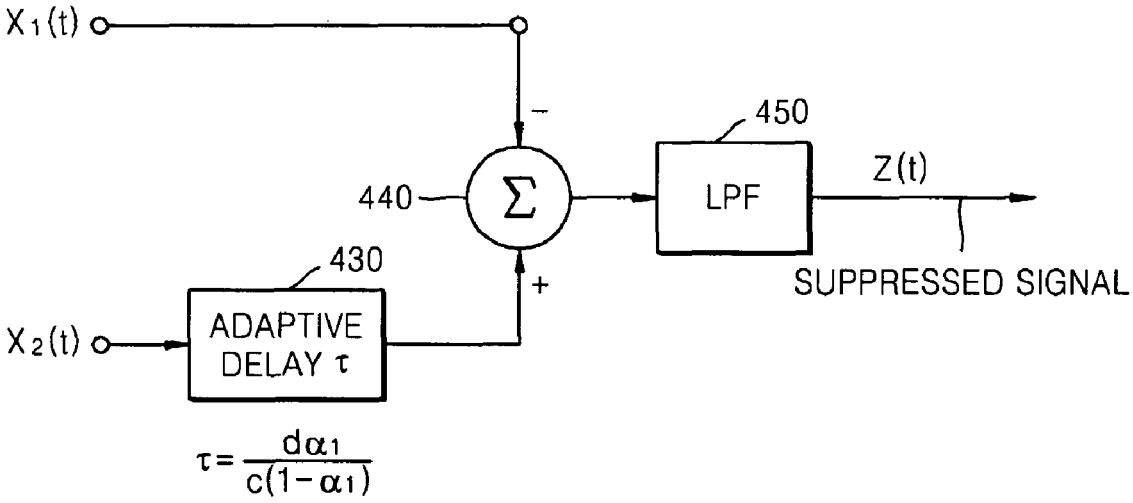

FIGS. 4A and 4B are block diagrams of target sound-suppressing beam formers according to embodiments of the present invention. A method using a fixed filter and an alternative method using an adaptive delay is illustrated in FIGS. 4A and 4B respectively.

As in FIG. 3A, it is assumed in FIG. 4A that a target sound source is placed in front of a microphone array 410. In addition, it is assumed that sound sources are located at positions including positions A, B and C, respectively. As in FIG. 3A, since it is assumed in FIG. 4A that the target sound source is located in front of the microphone array 410, that is, at the position A, sounds generated by the sound sources located at the positions B and C are interference noises.

In FIG. 4A, positive and negative signal values are alternately assigned to sound signals which are received through the microphone array 410. Then, an adder 420 adds the sound signals to suppress directivity toward the target sound source. The positive and negative signal values illustrated in FIG. 4A may be assigned to the sound signals by multiplying the sound signals by a matrix that may be embodied as (−1, +1, −1, +1). A matrix, which alternately assigns positive and negative signs to sound signals input to adjacent microphones in order to attenuate the sound signals, is referred to as a blocking matrix.

A process of suppressing directivity will now be described in more detail. When a mixed sound signal is input to the microphone array 410, a sound signal, which is included in the mixed sound signal and transmitted from the position A in front of the microphone array 410 may also be input to the microphone array 410. In this case, the phases and sizes of the sound signals received by each pair of adjacent microphones among four microphones of the microphone array 410 may be very similar to each other. That is, the sound signals received through first and second, second and third, or third and fourth microphones may be very similar to each other.

Therefore, after opposite signs are assigned to the sound signals received through each pair of adjacent microphones, if an adder 420 adds the sound signals, the sound signals assigned with opposite signs may offset each other. Consequently, the gain or sound pressure of the sound signal from the sound source located at the position A in front of the microphone array 410 is reduced, which, in turn, suppresses directivity toward the target sound source.

On the other hand, when a sound signal generated by the sound source at the position B or C is input to the microphone array 410, each microphone of the microphone array 410 may experience a delay in receiving the sound signal. In this case, the duration of the delay may depend on the distance between the sound source and each microphone. That is, the sound signal transmitted from the position B or C arrives at each microphone at a different time. Due to the difference in the arrival times of the sound signal at the microphones, even if opposite signs are assigned to the sound signals received by each pair of adjacent microphones and then the sound signals are added by the adder 420, the sound signals do not greatly offset each other due to their different arrival times. Therefore, if opposite signs are assigned to the sound signals received by each pair of adjacent microphones of the microphone array 410 and then if the sound signals are added by the adder 420 as in the present embodiment, directivity toward the target sound source in front of the microphone array 410 can be suppressed.

FIG. 4B is a block diagram of a target sound-suppressing beam former for suppressing directivity toward a target sound source. Since the target sound-beam former of FIG. 4B also uses the first-order differential microphone structure described above with reference to FIG. 3B, a description of such an exemplary embodiment will focus on the difference between the beam formers of FIGS. 3B and 4B. When sound signals $X_1(t)$ and $X_2(t)$ are received through a microphone array, a delay unit, for example an adaptive delay unit 430, delays the sound signal $X_2(t)$ by a predetermined period of time through an adaptive delay control. Then, contrary to the subtractor 340 in FIG. 3, a subtractor 440 subtracts the sound signal $X_1(t)$ from the delayed sound signal $X_2(t)$. Finally, an LPF 450 filters the subtraction result and outputs a suppressed sound signal Z(t) which is suppressed as compared to a sound signal transmitted from the direction of the target sound source.

The present exemplary embodiment is identical to the previous exemplary embodiment illustrated in FIG. 3B in that directional control factors are controlled using Equation 1 described above to control an adaptive delay. However, the present exemplary embodiment is different from the previous exemplary embodiment in that the adaptive delay is controlled to suppress directivity toward the target sound source. That is, the target sound-suppressing beam former of FIG. 4B reduces the sound pressure of a sound signal transmitted from the direction, in which the target sound source is located, to microphone array. The present embodiment is also different from the previous embodiment in that the subtractor 440 assigns opposite signs to input signals and subtracts the input signals from each other in order to suppress directivity toward the target sound source.

The beam formers which emphasize or suppress directivity toward a target sound source according to various embodiments of the present invention have been described above with reference to FIGS. 3A through 4B. Now, referring back to FIG. 2A, the beam former 220 generates an emphasized signal Y(τ) (251) and a suppressed signal Z(τ) (252) using the emphasized signal beam former 221 and the suppressed signal beam former 222, respectively. The beam former 220 may use a number of effective control techniques which emphasize or suppress directivity toward a target source based on the directivity of sound delivery.

The signal extractor 230 may include a time-frequency masking filter (hereinafter, masking filter) 231 and a mixer 232. The signal extractor 230 extracts a target sound signal from the emphasized signal Y(τ) (251) using the masking filter 230 which is set according to a ratio of the amplitude of the emphasized signal Y(τ) (251) to that of the suppressed signal Z(τ) (252) in a time-frequency domain. In this case, the emphasized signal Y(τ) (251) and the suppressed signal Z(τ) (252) are input values. As used herein, the term "masking" refers to a case where a signal suppresses other signals when a number of signals exist at the same time or at adjacent times. Thus, masking is performed based on the expectation that a clearer sound signal will be extracted if sound signal components can suppress interference noise components when a sound signal coexists with interference noise.

The masking filter 231 receives the emphasized signal Y(τ) (251) and the suppressed signal Z(τ) (252) and filters them based on a ratio of the amplitude of the emphasized signal Y(τ) (251) to that of the suppressed signal Z(τ) (252) in the time-frequency domain. The mixer 232 mixes the emphasized signal Y(τ) (251) with a signal output from the masking filter 231, thereby extracting a target sound signal O(τ,f) (240) from which interference noise is removed. A filtering process performed by the masking filter 231 of the signal extractor 230 will now be described in more detail with reference to FIG. 5.

Figure 5:
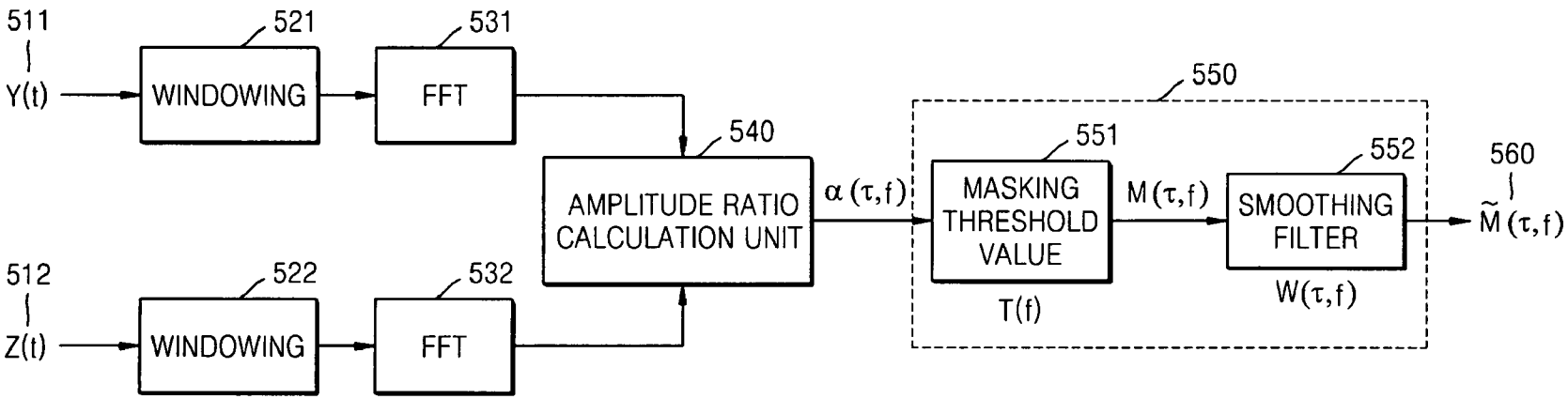
FIG. 5 is a block diagram of a masking filter according to an embodiment of the present invention.

FIG. 5 is a block diagram of a masking filter 231 illustrated in FIG. 2A according to an embodiment of the present invention. Referring to FIG. 5, the masking filter (231 in FIG. 2A) includes window functions 521 and 522, fast Fourier transform (FFT) units 531 and 532, an amplitude ratio calculation unit 540, and a masking filter-setting unit 550.

The window functions 521 and 522 reconfigure an emphasized signal Y(t) (511) and a suppressed signal Z(t) (512) generated by a beam former (not shown) into individual frames, respectively. In this case, a frame denotes each of a plurality of units into which a sound signal is divided according to time. In addition, a window function denotes a type of filter used to divide a successive sound signal into a plurality of sections, that is, frames, according to time and process the frames. In the case of digital signal processing, a signal is input to a system, and a signal output from the system is represented using convolutions. To limit a given target signal to a finite signal, the target signal is divided into a plurality of individual frames by a window function and processed accordingly. A major example of the window function is a Hamming window, which may be easily understood by those of ordinary skill in the art to which the embodiment pertains.

The emphasized signal Y(t) (511) and the suppressed signal Z(t) (512) reconfigured by the window functions 521 and 522 are transformed into signals in the time-frequency domain by the FFT units 531 and 532 for ease of calculation. Then, an amplitude ratio may be calculated based on the signals in the time-frequency domain as given by Equation 2 below, for example.

$$\alpha(\tau, f) = \frac{|Y(\tau, f)|}{|Z(\tau, f)|} \quad \text{Equation 2}$$

Here, τ indicates time, f indicates frequency, and an amplitude ratio α(τ,f) is represented by a ratio of absolute values of an emphasized signal Y(τ,f) and a suppressed signal Z(τ,f). That is, the amplitude ratio α(τ,f) in Equation 2 denotes a ratio of an emphasized signal and a suppressed signal which are included in individual frames in the time-frequency domain.

The masking filter-setting unit 550 illustrated in FIG. 5 sets a soft masking filter 560 based on the amplitude ratio α(τ,f) which is calculated by the amplitude ratio calculation unit 540. Two methods of setting a masking filter are suggested below as exemplary embodiments of the present invention.

First, a masking filter may be set using a binary masking filter and a soft masking filter calculated from the binary masking filter. Here, the binary masking filter is a filter which produces only zero and one as output values. The binary masking filter is also referred to as a hard masking filter. On the other hand, the soft masking filter is a filter which is controlled to linearly and gently increase or decrease in response to the variation of binary numbers output from the binary masking filter.

The masking filter-setting unit 550 illustrated in FIG. 5 sets the soft masking filter 560 by using the binary masking filter described above. The binary masking filter may be calculated from a frequency ratio as defined by Equation 3 below, for example.

$$M(\tau, f) = \begin{cases} 1, & \text{if } \alpha(\tau, f) \geq T(f) \\ 0, & \text{if } \alpha(\tau, f) < T(f) \end{cases} \quad \text{Equation 3}$$

Here, T(f) indicates a masking threshold value according to a frequency f of a sound signal. As the masking threshold value T(f), an appropriate value, which can be used to determine whether a corresponding frame is a target signal or an interference noise, is experimentally obtained according to various embodiments of the present invention. Since the binary masking filter outputs only binary values of zero and one, it is referred to as a binary masking filter or a hard masking filter.

In Equation 3, if the amplitude ratio α(τ,f) is greater than or equal to the masking threshold value T(f), that is, if an emphasized signal is greater than a suppressed signal, the binary masking filter is set to one. On the contrary, if the amplitude ratio α(τ,f) is less than the masking threshold value T(f), that is, if the emphasized signal is smaller than the suppressed signal, the binary masking filter is set to zero. Masking in the time-frequency domain requires relatively less computation even when the number of microphones in a microphone array is less than that of adjacent sound sources including a target sound source. This is because the number of masking filters equalling the number of sound sources can be generated and perform a masking operation in order to extract a target sound. The number of microphones does not greatly affect the masking operation. Therefore, even when there are a plurality of sound sources, the masking filters can perform in a superior manner.

In FIG. 5, the amplitude ratio α(τ,f) calculated by the amplitude ratio calculation unit 540 is compared to a masking threshold value 551 and thus defined as a binary masking filter M(τ,f). Then, a smoothing filter 552 removes musical noise which can be generated due to the application of the binary masking filter M(τ,f). In this case, musical noise is residual noise which remains noticeable by failing to form groups with adjacent frames in a mask of individual frames defined by the binary masking filter.

Until now, various methods of removing the musical noise have been suggested. A popular example is a Gaussian filter. The Gaussian filter assigns a highest weight to a mean value among values of a plurality of signal blocks and lower weights to the other values of the signal blocks. Thus, the mean value is best filtered by the Gaussian filter, and a value further from the mean value is less filtered by the Gaussian filter.

Figure 6:
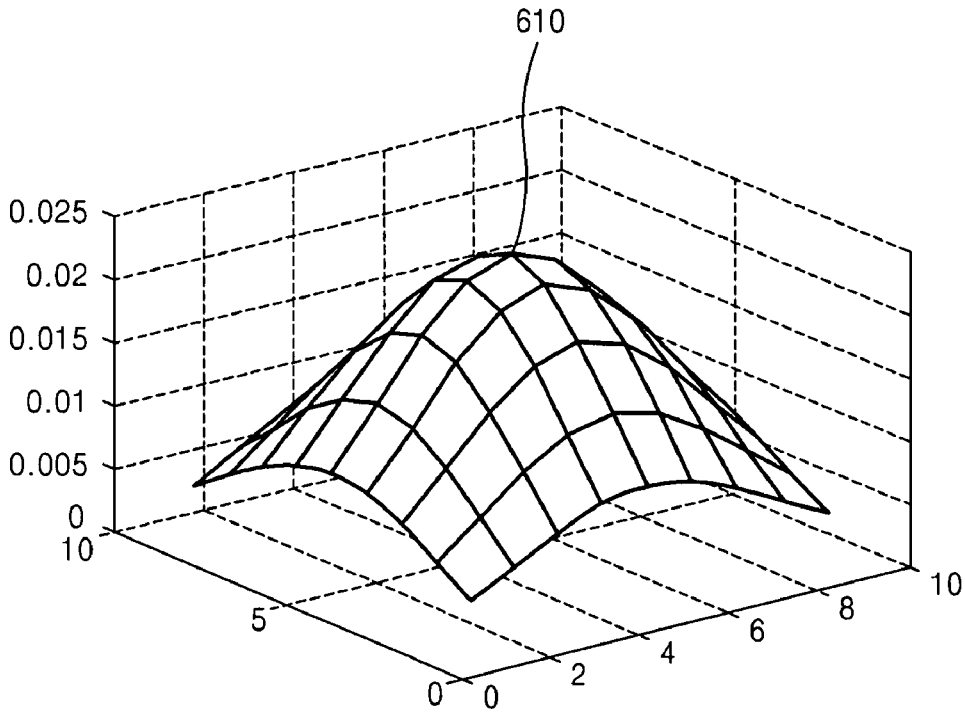
FIG. 6 is a graph illustrating a Gaussian filter which can be used to implement a masking filter according to embodiments of the present invention.

FIG. 6 is a graph illustrating the Gaussian filter which can be used to implement a masking filter according to an exemplary embodiment of the present invention. Two horizontal axes of the graph indicate signal blocks, and a vertical axis of the graph indicates the filtering rate of the Gaussian filter. It can be understood from FIG. 6 that a highest weight is given to a center 610 of the signal blocks and that the center 610 is preferably filtered.

Other than the Gaussian filter, various other filters may be used, such as a median filter which selects a median value from values of signal blocks of an equal size in horizontal and vertical directions. These various filters can be easily understood by those of ordinary skill in the art to which the embodiment pertains, and thus a detailed description thereof will be omitted.

Using the above methods, the binary masking filter M(τ,f) illustrated in FIG. 5 is multiplied by the smoothing filter 552 and finally set as the soft masking filter 560. The set soft masking filter 560 can be defined by Equation 4, for example.

$$\tilde{M}(\tau,f)=W(\tau,f)\otimes M(\tau,f) \quad \text{Equation 4}$$

Here, W(τ,f) indicates a Gaussian filter used as a smoothing filter. That is, in Equation 4, a soft masking filter is a Gaussian filter multiplied by a binary masking filter. Above, the method of setting a soft masking filter using a binary masking filter has been described. Next, a method of directly setting a soft masking filter by using an amplitude ratio will be described as another exemplary embodiment of the present invention.

In this next exemplary embodiment, the masking filter-setting unit 550 does not use a binary masking filter defined by the masking threshold value 551. Instead, the masking filter-setting unit 550 may model a sigmoid function which can directly set the soft masking filter 560 based on the amplitude ratio α(τ,f) calculated by the amplitude ratio calculation unit 540. The sigmoid function is a special function which transforms discontinuous and non-linear input values into continuous and linear values between zero and one. The sigmoid function is a type of transfer function which defines a transformation process from input values into output values. In particular, the sigmoid function is widely used in neural network theory. That is, when a model is developed, it is difficult to determine an optimum variable and an optimum function due to many input variables. Thus, according to neural network theory, the prediction capability of the model is enhanced based on learning through data accumulation, and the sigmoid function is widely used in this neural network theory.

In the present exemplary embodiment, the amplitude ratio $\alpha(\tau,f)$ is transformed into a value between zero and one by using the sigmoid function. Accordingly, the soft masking filter 560 can be directly set without using a binary masking filter.

Figure 7:
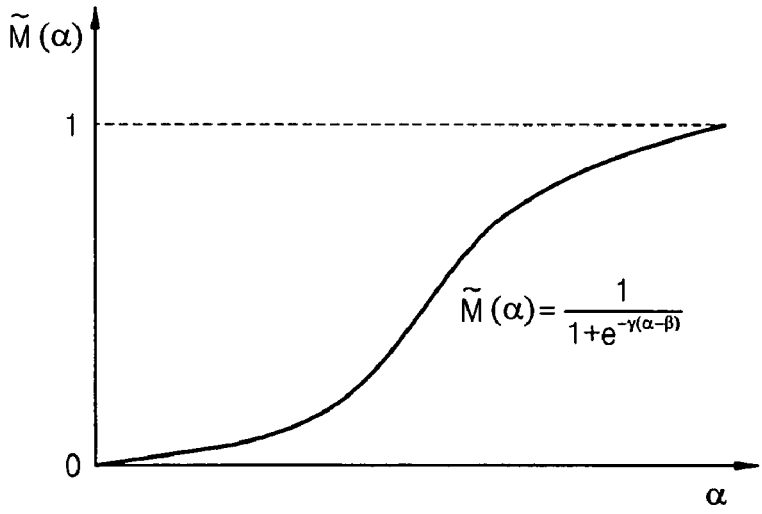
FIG. 7 is a graph illustrating a sigmoid function which can be used to implement a masking filter according to embodiments of the present invention.

FIG. 7 is a graph illustrating a sigmoid function which can be used to implement a masking filter according to another embodiment of the present invention. The sigmoid function of FIG. 7 is obtained after a conventional sigmoid function is moved to the right by a predetermined value $\beta$ to have a value of zero at the origin. In FIG. 7, a horizontal axis indicates an amplitude ratio $\alpha$, and a vertical axis indicates a soft masking filter. The relationship between the amplitude ratio $\alpha$ and the soft masking filter can be defined by Equation 5 below, for example.

$$\tilde{M}(\tau, f) = \frac{1}{1 + e^{-\gamma \cdot \alpha(\tau, f)}} \quad \text{Equation 5}$$

Here, $\gamma$ is a variable indicating the inclination of the sigmoid function. It can be understood from Equation 5 and FIG. 7 that the sigmoid function receives the amplitude ratio $\alpha$, which is a discontinuous and arbitrary value, and outputs a continuous value between zero and one. Therefore, the masking filter-setting unit 550 may directly set the soft masking filter 560 without comparing the amplitude ratio $\alpha(\tau,f)$ calculated by the amplitude ratio calculation unit 540 to the masking threshold value 551.

Referring back to FIG. 2A, the signal extractor 230 filters the emphasized signal $Y(\tau)$ (251) by using the masking filter 231, which is set as described above, and finally extracts the target sound signal $O(\tau,f)$ (240). The extracted target sound signal $O(\tau,f)$ (240) can be defined by Equation 6, for example.

$$O(\tau,f)=\tilde{M}(\tau,f)\cdot Y(\tau,f) \quad \text{Equation 6}$$

Since the extracted target sound signal $O(\tau,f)$ (240) is a value in the time-frequency domain, it is inverse FFTed into a value in the time domain.

The apparatus for extracting a target sound signal when information regarding the direction of a target sound source is given has been described above with reference to FIG. 2A. The apparatus according these embodiments of the present invention can clearly separate a target sound signal from a mixed sound signal, which contains a plurality of sound signals, input to a microphone array.

The apparatus for extracting a target sound signal when information regarding the direction of a target sound source is not given will now be described.

FIG. 2B is a block diagram of the apparatus for extracting a target sound signal when information regarding the direction of a target sound source is not given according to the following embodiments of the present invention. Like the apparatus of FIG. 2A, the apparatus of FIG. 2B includes a microphone array 210, a beam former 220 and a signal extractor 230. Unlike the apparatus of FIG. 2A, the apparatus of FIG. 2B further includes a sound source search unit 223. A description of the present embodiment will be focused on the difference between the apparatuses of FIGS. 2A and 2B.

When information regarding the position of a target sound source is not given, the sound source search unit 223 searches for the position of the target sound source in the microphone array 210 using various algorithms which will be described below. As described above, a sound signal having dominant signal characteristics, that is, the sound signal having the biggest gain or sound pressure, from among a plurality of sound signals contained in a mixed sound signal is generally determined as a target sound source. Therefore, the sound source search unit 223 detects the direction or position of the target sound source based on the mixed sound signal which is input to the microphone array 210. In this case, dominant signal characteristics of a sound signal may be identified based on objective measurement values such as a signal-to-noise ratio (SNR) of the sound signal. Thus, the direction of a sound source, which generated a sound signal having relatively higher measurement values, may be determined as the direction in which a target sound source is located.

Various methods of searching for the position of a target sound source, such as time delay of arrival (TDOA), beam forming and high-definition spectral analysis, have been widely introduced and will be briefly described below.

In TDOA, the difference in the arrival times of a mixed sound signal at each pair of microphones of the microphone array 210 is measured, and the direction of a target sound source is estimated based on the measured difference. Then, the sound source search unit 223 estimates a spatial position, at which the estimated directions cross each other, to be the position of the target sound source.

In beam forming, the sound source search unit 223 delays a sound signal which is received at a particular angle, scans sound signals in space at each angle, selects a direction, in which a sound signal having a highest value is scanned, as the direction of a target sound source, and estimates a position, at which a sound signal having a highest value is scanned, to be the position of a target sound source.

The above methods of searching for the position of a target sound source can be easily understood by those of ordinary skill in the art to which the embodiments pertain, and thus a more detailed description thereof will be omitted (Juyang Weng, "Three-Dimensional Sound Localization from Compact Non-Coplanar Array of Microphones Using Tree-Based Learning," pp. 310-323, 110(1), JASA 2001).

After the sound source search unit 223 determines the direction of the target sound source according to the various embodiments of the present invention described above, it transmits the mixed sound signal to an emphasized signal beam former 221 and a suppressed signal beam former 222 based on the determined direction of the target sound source. The subsequent process is identical to the process described above with reference to FIG. 2A. The apparatus according to the present embodiments can clearly separate a target sound signal from a mixed sound signal, which contains a plurality of sound signals, input to a microphone array when information regarding the direction of a target sound source is not given.

Figure 8:
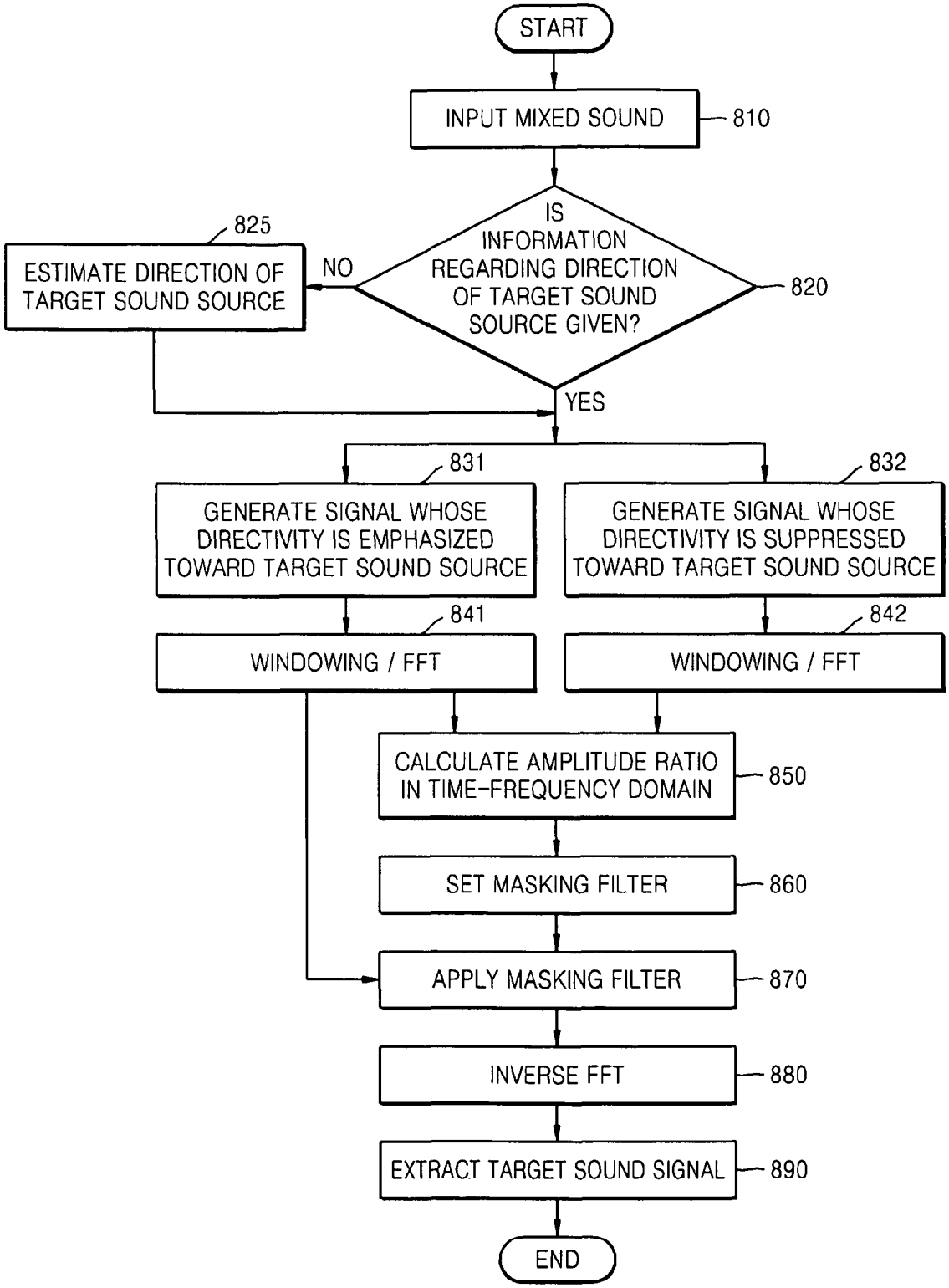
FIG. 8 is a flowchart illustrating a method of extracting a target sound signal according to an embodiment of the present invention.

FIG. 8 is a flowchart illustrating a method of extracting a target sound signal according to embodiments of the present invention.

Referring to FIG. 8, in operation 810, a mixed sound signal is input to a microphone array from a plurality of sound sources placed around the microphone array. In operation 820, it is determined whether information regarding the direction of a target sound source is given. If the information regarding the direction of the target sound source is given, operation 825 is skipped, and a next operation is performed. If the information regarding the direction of the target sound source is not given, operation 825 is performed. That is, a sound source, which generated a sound signal having dominant signal characteristics, is detected from the sound sources, and the direction in which the sound source is located is set as the direction of the target sound source. This operation corresponds to the sound source search operation performed by the sound source search unit 223 which has been described above with reference to FIG. 2B.

In operations 831 and 832, an emphasized signal having directivity toward the target sound source and a suppressed signal whose directivity is suppressed directivity are generated. These operations correspond to the operations performed by the emphasized signal beam former 221 and the suppressed signal beam former 222 which have been described above with reference to FIGS. 2A and 2B.

In operations 841 and 842, the emphasized signal and the suppressed signal generated in operations 831 and 832, respectively, are filtered using a window function. Each of operations 841 and 842 corresponds to a process of dividing a continuous signal into a plurality of individual frames of uniform size in order to perform a convolution operation on the continuous signal. The individual frames are FFTed into frames in the time-frequency domain. That is, the emphasized signal and the suppressed signal are transformed into those in the time-frequency domain in operations 841 and 842.

In operation 850, an amplitude ratio of the emphasized signal to the suppressed signal in the time-frequency domain is calculated. The amplitude ratio provides information regarding a ratio of a target sound to an interference noise which is contained in an individual frame of sound signal.

In operation 860, a masking filter is set based on the calculated amplitude ratio. The methods of setting a masking filter according to two embodiments of the present invention have been suggested above; a method of setting a masking filter by using a binary masking filter and a masking threshold value and a method of directly setting a soft masking filter by using a sigmoid function.

In operation 870, the set masking filter is applied to the emphasized signal. That is, the emphasized signal is multiplied by the masking filter so as to extract a target sound signal.

In operation 880, the extracted target sound signal is inverse FFT-ed into a target sound signal in the time domain. The target sound signal in the time domain is finally extracted in operation 890.

In addition to the above described embodiments, embodiments of the present invention can also be implemented through computer readable code/instructions in/on a medium, e.g., a computer readable medium, to control at least one processing element to implement any above described embodiments and display the resultant image on a display. The medium can correspond to any medium/media permitting the storing and/or transmission of the computer readable code.

The computer readable code can be recorded on a recording medium in a variety of ways, with examples including magnetic storage media (e.g., ROM, floppy disks, hard disks, etc.) and optical recording media (e.g., CD-ROMs, or DVDs). The computer readable code can also be transferred on transmission media such as media carrying or including carrier waves, as well as elements of the Internet, for example. Thus, the medium may be such a defined and measurable structure including or carrying a signal or information, such as a device carrying a bitstream, for example, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

While aspects of the present invention has been particularly shown and described with reference to differing embodiments thereof, it should be understood that these exemplary embodiments should be considered in a descriptive sense only and not for purposes of limitation. Descriptions of features or aspects within each embodiment should typically be considered as available for other similar features or aspects in the remaining embodiments.

Thus, although a few embodiments have been shown and described, it would be appreciated by those skilled in the art that changes may be made in these embodiments without departing from the principles and spirit of the invention, the scope of which is defined in the claims and their equivalents.

What is claimed is:

1. A method of extracting a target sound signal, the method comprising:

receiving a mixed signal through a microphone array;

generating a first signal which is emphasized and directed toward a target sound source and a second signal which is suppressed and directed toward the target sound source based on the mixed signal; and extracting a target sound signal from the first signal by masking an interference sound signal, which is contained in the first signal, based on a ratio of the first signal to the second signal.

2. The method of claim 1, wherein the extracting of the target sound signal comprises:

filtering the first signal and the second signal based on the ratio of the first signal to the second signal; and removing the interference sound signal from the first signal by mixing the first signal with a result of the filtering of the first signal and the second signal.

3. The method of claim 1, wherein the extracting of the target sound signal comprises setting coefficients of a masking filter based on an amplitude ratio of the first signal to the second signal in a time-frequency domain.

4. The method of claim 3, wherein the setting of the coefficients of the masking filter comprises:

defining a binary mask by comparing a value of the amplitude ratio of the first signal to the second signal in the time-frequency domain to a predetermined masking threshold value; and setting the coefficients of the masking filter by multiplying the defined binary mask by coefficients of a smoothing filter which removes residual noise.

5. The method of claim 3, wherein the setting of the coefficients of the masking filter comprises:

defining a predetermined transfer function which transforms the value of the amplitude ratio of the first signal to the second signal in the time-frequency domain into the coefficients of the masking filter; and setting the coefficients of the masking filter by inputting the value of the amplitude ratio to the defined transfer function.

6. The method of claim 1, further comprising detecting the direction of the target sound source from the mixed signal by using a predetermined sound source search algorithm.

7. The method of claim 6, wherein the predetermined sound source search algorithm is used to determine a direction relative to the microphone array of a sound source generating a sound signal having a relatively higher signal-to-noise (SNR) ratio compared to SNRs of sound signals generated by a plurality of sound sources around the microphone array, the determined direction directing towards the target sound source.

8. A computer-readable recording medium on which a program causing a computer to execute the method of claim 1, is recorded.

9. An apparatus for extracting a target sound signal, the apparatus comprising:

a microphone array receiving a mixed signal;

a beam former generating a first signal which is emphasized and directed toward a target sound source and a second signal which is suppressed and directed toward the target sound source, based on the mixed signal; and a signal extractor extracting a target sound signal from the first signal by masking an interference sound signal, which is contained in the first signal, based on a ratio of the first signal to the second signal.

10. The apparatus of claim 9, wherein the signal extractor comprises:

a masking filter filtering the first signal and the second signal based on the ratio of the first signal to the second signal; and a mixer removing the interference sound signal from the first signal by mixing the first signal with a result of the filtering of the first signal and the second signal.

11. The apparatus of claim 9, wherein the signal extractor comprises a masking filter coefficient-setting unit setting coefficients of a masking filter based on an amplitude ratio of the first signal to the second signal in a time-frequency domain.

12. The apparatus of claim 11, wherein the masking filter coefficient-setting unit comprises:

a binary mask defining unit defining a binary mask by comparing a value of the amplitude ratio of the first signal to the second signal in the time-frequency domain to a predetermined masking threshold value; and a multiplication unit setting the coefficients of the masking filter by multiplying the defined binary mask by coefficients of a smoothing filter which removes residual noise.

13. The apparatus of claim 11, wherein the masking filter coefficient-setting unit comprises a transfer function defining unit defining a predetermined transfer function, which transforms the value of the amplitude ratio of the first signal to the second signal in the time-frequency domain into the coefficients of the masking filter, and sets the coefficients of the masking filter by inputting the value of the amplitude ratio to the defined transfer function.

14. The apparatus of claim 9, further comprising a sound source search unit detecting the direction of the target sound source from the mixed signal by using a predetermined sound source search algorithm.

15. The apparatus of claim 14, wherein the predetermined sound source search algorithm is used to determine a direction relative to the microphone array of a sound source generating a sound signal having a relatively higher SNR ratio compared to SNRs of sound signals generated by a plurality of sound sources around the microphone array, the determined direction directing towards the target sound source.

* * * * *